US011699876B2

(12) United States Patent
Matsuura

(10) Patent No.: US 11,699,876 B2
(45) Date of Patent: Jul. 11, 2023

(54) CONNECTOR WITH LEVER AND GUIDE SURFACES

(71) Applicant: SUMITOMO WIRING SYSTEMS, LTD., Mie (JP)

(72) Inventor: Junya Matsuura, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/574,307

(22) Filed: Jan. 12, 2022

(65) Prior Publication Data

US 2022/0247124 A1 Aug. 4, 2022

(30) Foreign Application Priority Data

Jan. 29, 2021 (JP) ..... JP2021-012678

(51) Int. Cl.
*H01R 13/629* (2006.01)

(52) U.S. Cl.
CPC . *H01R 13/62933* (2013.01); *H01R 13/62977* (2013.01)

(58) Field of Classification Search
CPC ..... H01R 13/62977; H01R 13/62933
See application file for complete search history.

(56) References Cited

U.S. PATENT DOCUMENTS

| | | | | |
|---|---|---|---|---|
| 10,109,954 | B2 * | 10/2018 | Shimizu | H01R 13/502 |
| 11,437,756 | B2 * | 9/2022 | Shinmi | H01R 13/62938 |
| 2016/0108940 | A1 * | 4/2016 | Kritter | H01R 13/62938 403/409.1 |
| 2018/0109034 | A1 | 4/2018 | Suzuki et al. | |
| 2018/0331470 | A1 | 11/2018 | Suzuki et al. | |

FOREIGN PATENT DOCUMENTS

| | | |
|---|---|---|
| JP | 2003-282179 A | 10/2003 |
| JP | 2008-204663 A | 9/2008 |

* cited by examiner

*Primary Examiner* — Oscar C Jimenez
*Assistant Examiner* — Paul D Baillargeon
(74) *Attorney, Agent, or Firm* — Venjuris, P.C.

(57) ABSTRACT

A connector 10 includes a connector body 20 and a lever 50. The connector body 20 includes a guide portion 30. The lever 50 includes a guide receiving portion 60. The lever 50 is rotatable about a rotary shaft 54 with respect to the connector body 20 to a guide start position where guide by the guide portion 30 is started and a guide end position where the guide by the guide portion 30 is ended. At least one of the guide portion 30 and the guide receiving portion 60 arcuately extends with the rotary shaft 54 as a center. The guide receiving portion 60 contacts the guide portion 30 with a larger contact pressure when the lever 50 is at the guide end position than when the lever 50 is at the guide start position.

2 Claims, 11 Drawing Sheets

CONNECTOR WITH LEVER AND GUIDE SURFACES

CROSS-REFERENCE TO RELATED APPLICATIONS

This application is based on and claims priority from Japanese Patent Application No. 2021-012678, filed on Jan. 29, 2021, with the Japan Patent Office, the disclosure of which is incorporated herein in its entirety by reference.

TECHNICAL FIELD

The present disclosure relates to a connector.

BACKGROUND

A connector disclosed in Japanese Patent Laid-open Publication No. 2018-063918 is a lever-type connector and includes a connector body (connector housing) and a lever rotatably supported on the connector body. This connector is connected to a mating connector by rotating the lever from an initial position to a connection position. A connector provided with a lever is also disclosed in Japanese Patent Laid-open Publication Nos. 2003-282179, 2008-204663, and 2018-195400.

SUMMARY

In the connector of Japanese Patent Laid-open Publication No. 2018-063918, if vibration is applied from outside with the lever arranged at the connection position, the connector body and the lever may rattle each other.

Accordingly, the present disclosure aims to provide a technique capable of suppressing the rattling of a connector body and a lever.

The present disclosure is directed to a connector with a connector body including a guide portion, and a lever including a guide receiving portion for contacting the guide portion, the lever being operated to connect the connector to a mating connector, wherein the lever is rotatable about a rotary shaft with respect to the connector body to a guide start position where guide by the guide portion is started and a guide end position where the guide by the guide portion is ended, at least one of the guide portion and the guide receiving portion arcuately extends with the rotary shaft as a center, and the guide receiving portion contacts the guide portion with a larger contact pressure when the lever is at the guide end position than when the lever is at the guide start position.

According to the present disclosure, it is possible to suppress the rattling of a connector body and a lever.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
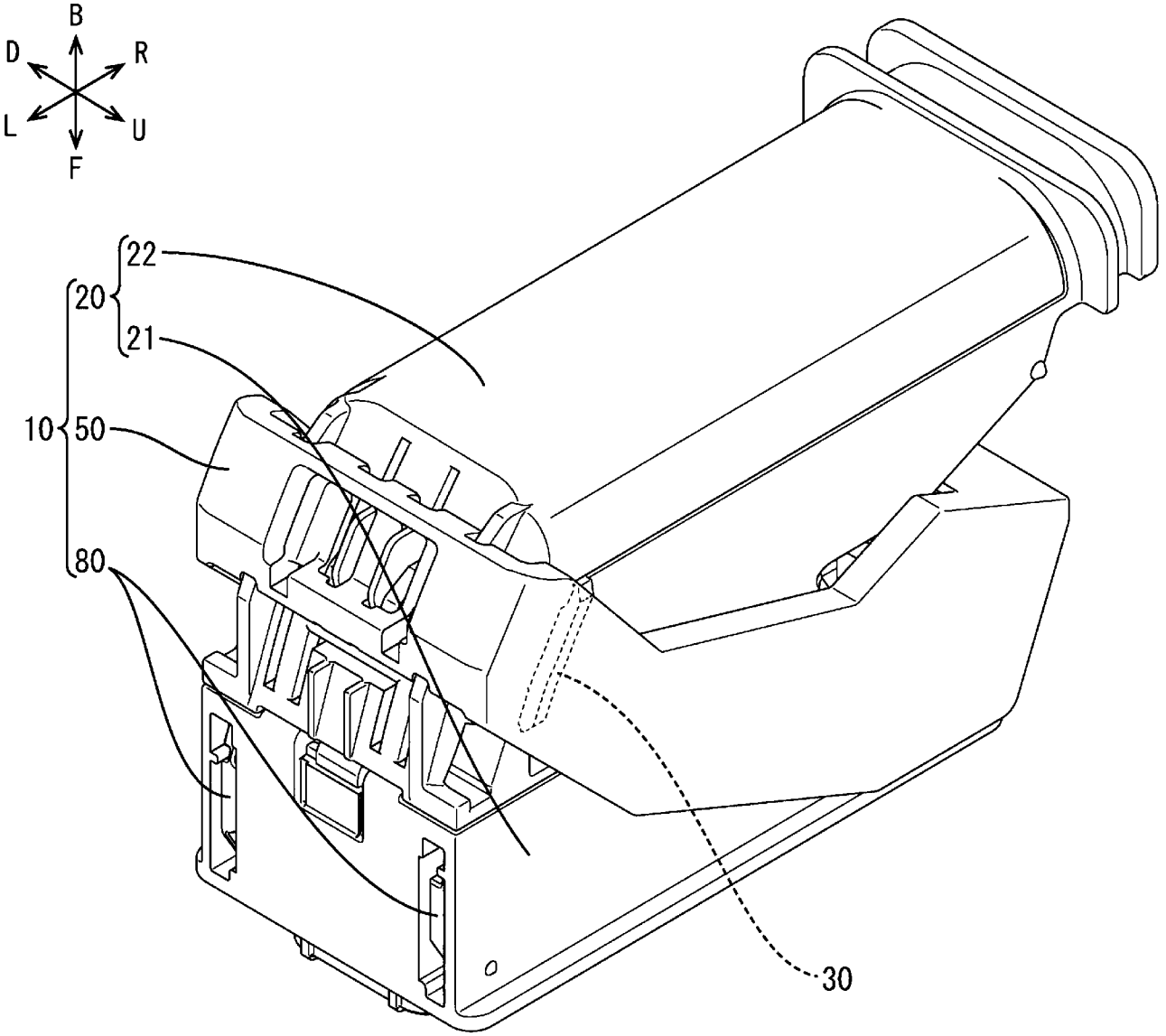
FIG. 1 is a perspective view of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of Present Disclosure]

First, embodiments of the present disclosure are listed and described.

(1) The connector of the present disclosure is provided with a connector body including a guide portion, and a lever including a guide receiving portion for contacting the guide portion, the lever being operated to connect the connector to a mating connector, wherein the lever is rotatable about a rotary shaft with respect to the connector body to a guide start position where guide by the guide portion is started and a guide end position where the guide by the guide portion is ended, at least one of the guide portion and the guide receiving portion arcuately extends with the rotary shaft as a center, and the guide receiving portion contacts the guide portion with a larger contact pressure when the lever is at the guide end position than when the lever is at the guide start position.

In this connector, the guide receiving portion can be brought into contact with the guide portion with a larger contact pressure when the lever is at the guide end position than when the lever is at the guide start position. Thus, the rattling of the lever arranged at the guide end position and the connector body can be suppressed.

(2) Preferably, one of the guide portion and the guide receiving portion has a first guide surface in contact with or facing the other at the guide start position, a second guide surface arranged at a position more away from the rotary shaft than the first guide surface and in contact with the other at the guide end position, and a third guide surface obliquely connected to the first and second guide surfaces.

Since this connector has the third guide surface obliquely connected to the first and second guide surfaces, the lever can be smoothly moved from the guide start position to the guide end position.

(3) Preferably, the one of the guide portion and the guide receiving portion includes a projection on the second guide surface, the other includes a recess to be fit to the projection at the guide end position, and the recess is in contact with the projection on both sides in a rotating direction of the lever when viewed from a direction parallel to an axis of the rotary shaft.

In this connector, the recess is in contact with the projection on both sides in the rotating direction when viewed from the direction parallel to the axis of the rotary shaft. Thus, a state where the projection is fit in the recess without rattling can be maintained. As a result, the rattling of the lever and the connector body can be more effectively suppressed.

(4) Preferably, the connector body includes a locking portion, the lever includes a lock receiving portion lockable to the locking portion, and the locking portion and the lock receiving portion do not contact each other and are arranged to face each other in a rotating direction of the lever when the lever is at the guide end position.

In this connector, the locking portion and the lock receiving portion do not contact each other and are arranged to face each other in the rotating direction of the lever when the lever is at the guide end position. Thus, if external vibration is applied to the connector, the transmission of the vibration between the locking portion and the lock receiving portion can be suppressed.

[Details of Embodiment of Present Disclosure]

A specific example of the present disclosure is described below with reference to the drawings. Note that the present invention is not limited to these illustrations and is intended to be represented by claims and include all changes in the scope of claims and in the meaning and scope of equivalents.

Embodiment

Figure 4:
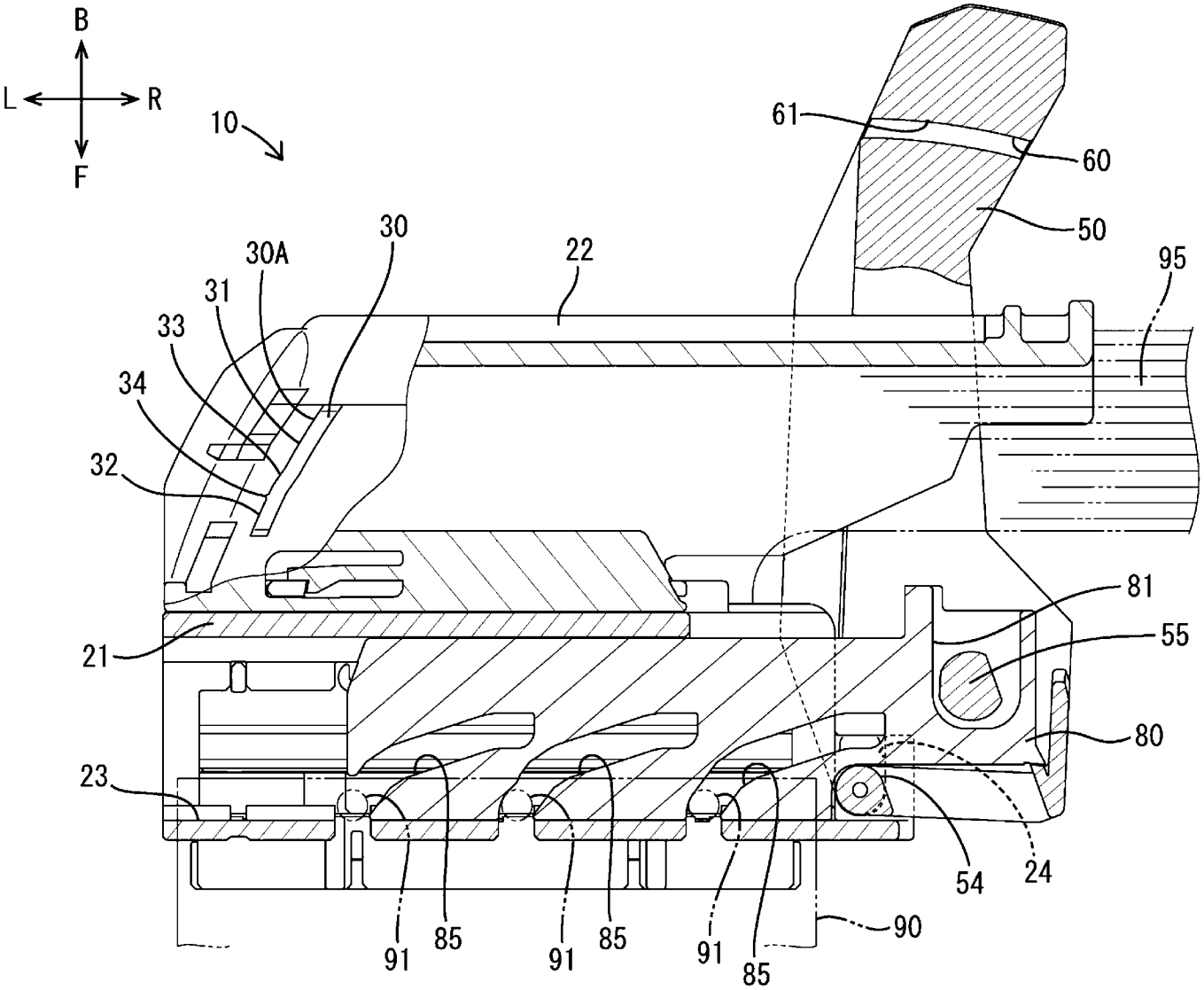
FIG. 4 is a plan view in section showing the connector in a state where the lever is arranged at an initial position.
Figure 5:
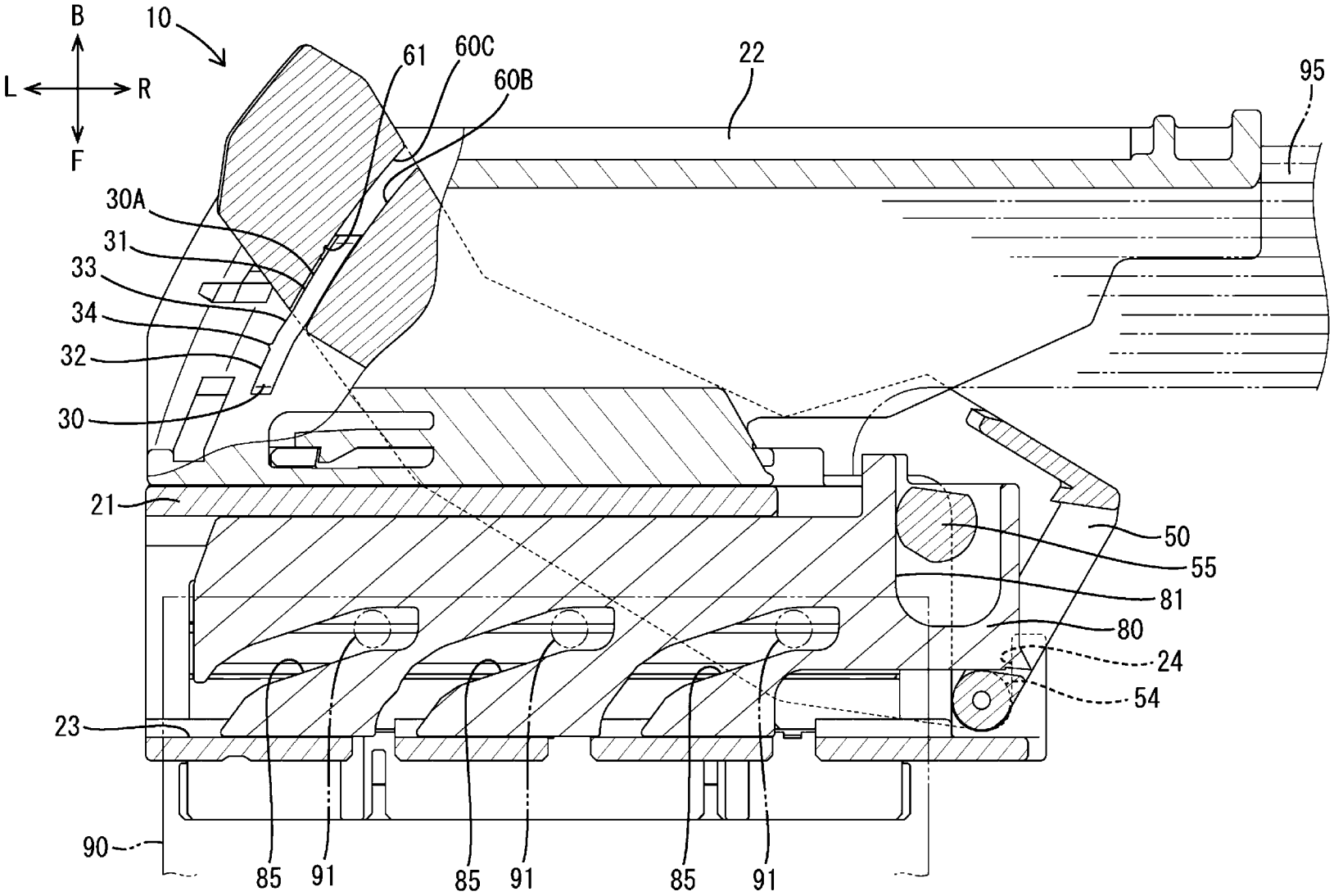
FIG. 5 is a plan view in section of the connector in a state where the lever is arranged at a guide start position.
Figure 6:
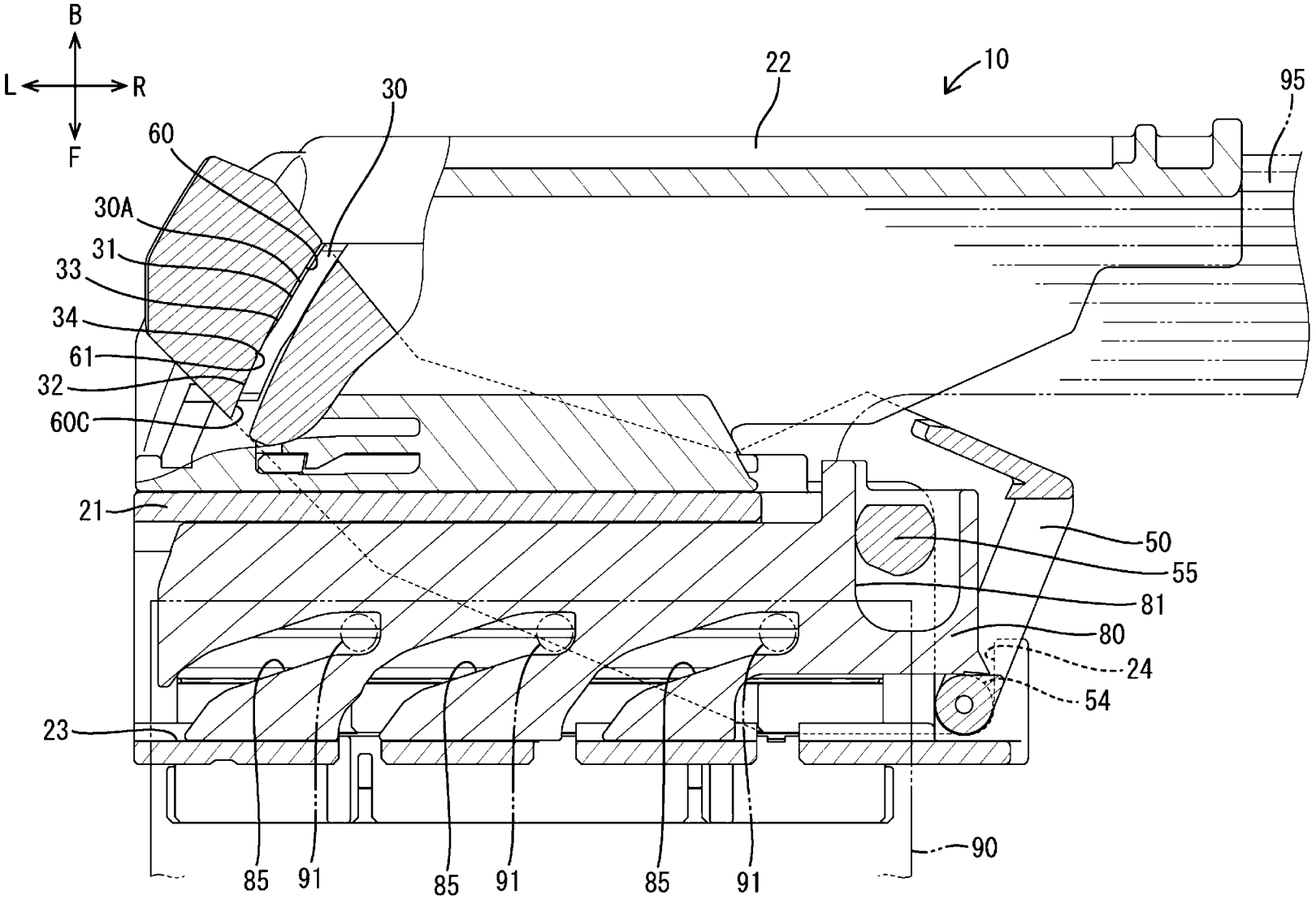
FIG. 6 is a plan view in section of the connector in a state where the lever is arranged at a guide end position.

A connector 10 is illustrated in one embodiment. The connector 10 is a lever-type connector. As shown in FIG. 1, the connector 10 includes a connector body 20, a lever 50 and a pair of sliders 80. The lever 50 is rotated from an initial position to a guide start position with respect to the connector body 20 and further rotated to a guide end position after passing through the guide start position. As shown in FIGS. 4 to 6, the pair of sliders 80 pull a mating connector 90 toward the connector 10 according to the rotation of the lever 50, whereby the connector 10 is connected to the mating connector 90.

Figure 2:
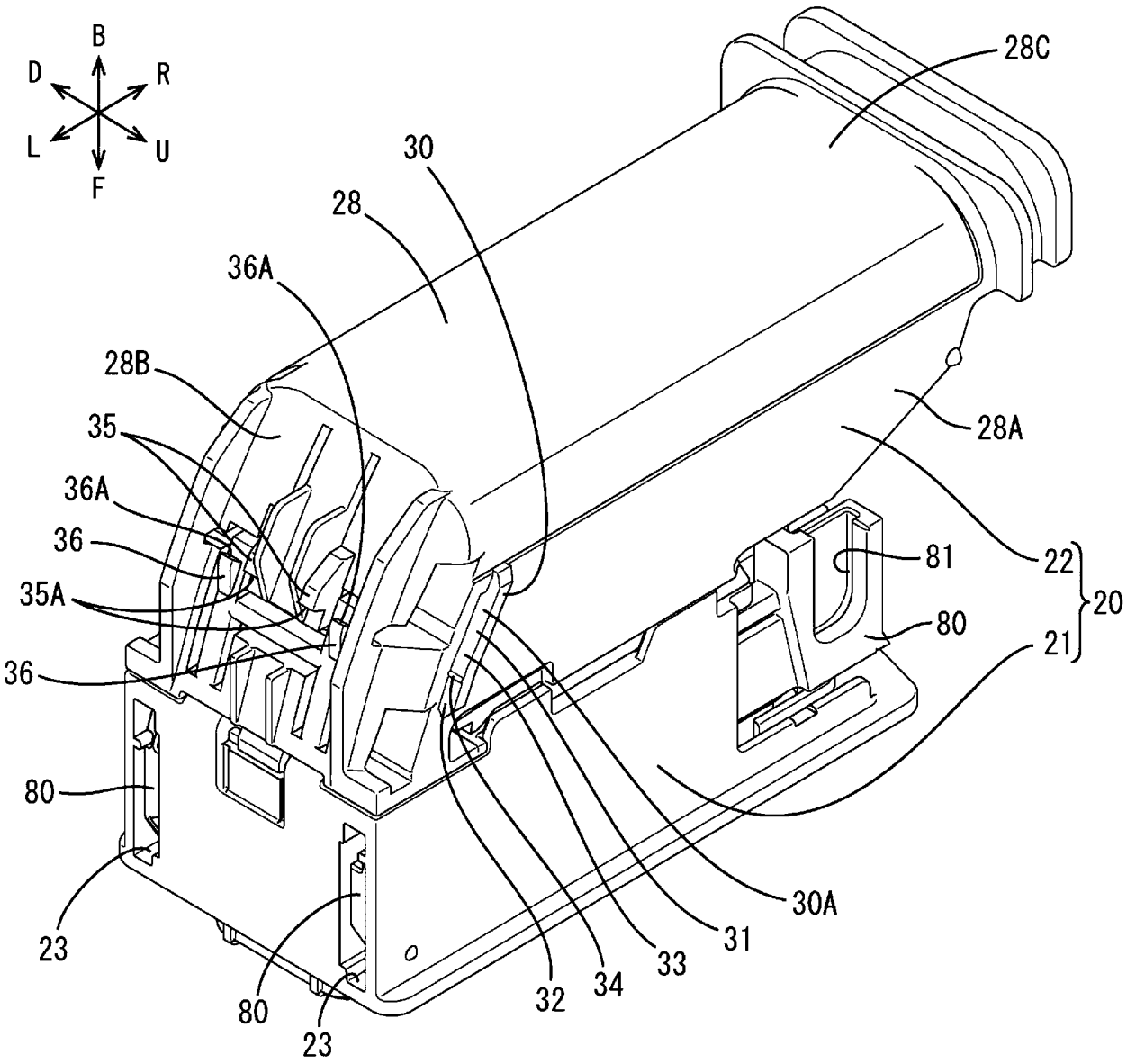
FIG. 2 is a perspective view showing a state where a lever is removed from the connector.

Note that, in the following description, a side of the connector 10 to be connected to the mating connector 90 is referred to as a front side and an opposite side thereof is referred to as a back side concerning a front-back direction. A direction parallel to axes of later-described rotary shafts 54 (see FIG. 6) located at a center of rotation of the lever 50 is referred to as a vertical direction. An oblique left-lower side and an oblique right-upper side in FIG. 2 are referred to as a left side and a right side concerning a lateral direction, and a lateral direction shown in FIGS. 4 to 6 is directly referred to as the lateral direction. Concerning a rotating direction of the lever 50, a direction rotating from the initial position to the guide end position is referred to as a connecting direction, and an opposite direction thereof is referred to as a releasing direction. Note that, in figures, "F", "B", "U", "D", "L" and "R" denote a front side, a back side, an upper side, a lower side, a left side and a right side.

The connector body 20 is made of synthetic resin. An unillustrated plurality of terminal fittings are mounted into the connector body 20. As shown in FIG. 2, the connector body 20 includes a housing 21 in the form of a block long in the lateral direction and a wire cover 22 to be mounted on a back side of the housing 21.

The unillustrated plurality of terminal fittings are accommodated inside the housing 21. Wires 95 (see FIG. 6) attached to the terminal fittings are drawn out through an opening in the back surface of the housing 21. As shown in FIGS. 2 and 6, the housing 21 is formed with a pair of upper and lower slide guide recesses 23 extending in the lateral direction. Both left and right ends of the slider guide recesses 23 are open in both left and right surfaces of the housing 21. The sliders 80 are accommodated into the slider guide recesses 23. The housing 21 is formed with a pair of upper and lower rotary shaft receiving portions 24. The pair of rotary shaft receiving portions 24 are arranged on a right end side of the housing 21. The rotary shaft receiving portions 24 rotatably support the lever 50.

As shown in FIG. 2, the wire cover 22 includes a cover body 28, a pair of upper and lower guide portions 30, a pair of upper and lower first locking portions 35 and a pair of upper and lower second locking portions 36. The cover body 28 is mounted to cover the back surface of the housing 21 with respect to the housing 21. The cover body 28 is mounted on the housing 21 by being slid rightward along the back surface of the housing 21.

As shown in FIG. 2, the cover body 28 includes a pair of upper and lower plate portions 28A, a left plate portion 28B coupling left end parts of the pair of upper and lower plate portions 28A and a back plate portion 28C coupling back end parts of the pair of upper and lower plate portions 28A. As shown in FIG. 6, the cover body 28 is open in front and right surfaces, and holds the wires 95 drawn out backward through the opening in the back surface of the housing 21 in a state bent rightward.

Figure 7:
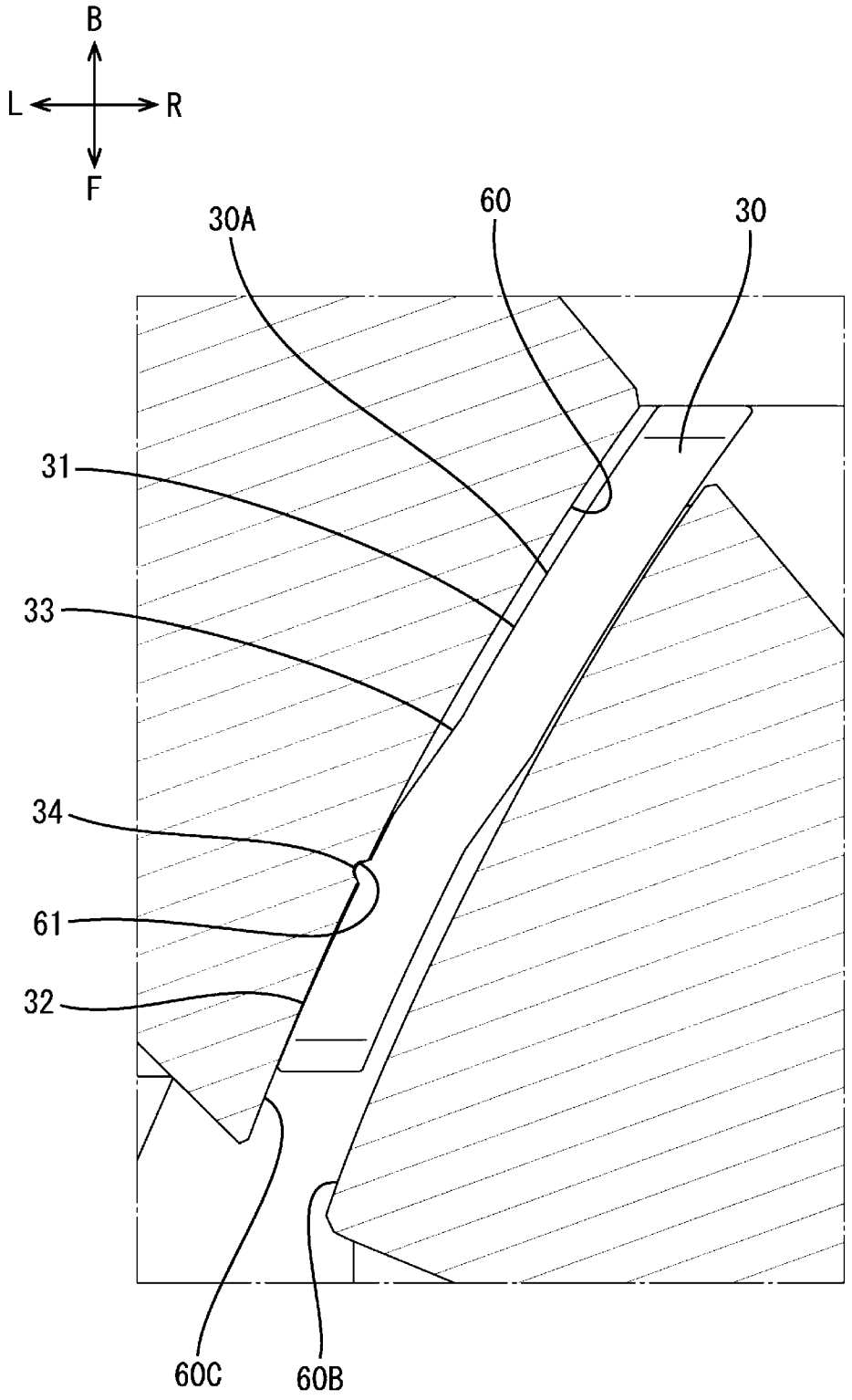
FIG. 7 is an enlarged view of a guide portion and a guide receiving portion shown in FIG. 6.

As shown in FIG. 2, the guide portions 30 project from the upper and lower surfaces of the cover body 28, i.e. the outer side surfaces of the pair of upper and lower plate portions 28A. As shown in FIG. 6, the guide portion 30 arcuately extends as a whole with the later-described rotary shaft 54 of the lever 50 as a center. As shown in FIG. 2, the guide portion 30 has a guide surface 30A for guiding the rotation of the lever 50. As shown in FIG. 7, the guide surface 30A is composed of a first guide surface 31, a second guide surface 32 and a third guide surface 33.

As shown in FIG. 6, if a direction connecting the guide portion 30 and the rotary shaft receiving portion 24 is a radial direction, the first, second and third guide surfaces 31, 32 and 33 are formed on a radially outer surface of the guide portion 30, i.e. a surface of the guide portion 30 opposite to the rotary shaft 54. The first, second and third guide surfaces 31, 32 and 33 are arranged in this order along an extending direction of the guide portion 30, more specifically the connecting direction of the lever 50. The first and second guide surfaces 31, 32 arcuately extend along an arc centered on the rotary shaft 54. The second guide surface 32 is arranged at a position more away from the rotary shaft 54 than the first guide surface 31. The third guide surface 33 is obliquely connected to the first and second guide surfaces 31, 32. A radially inner surface of the guide portion 30 is arranged in parallel to the first, second and third guide surfaces 31, 32 and 33. The guide portion 30 has a constant lateral width in the extending direction of the guide portion 30 except at a projection 34 to be described later.

Figure 8:
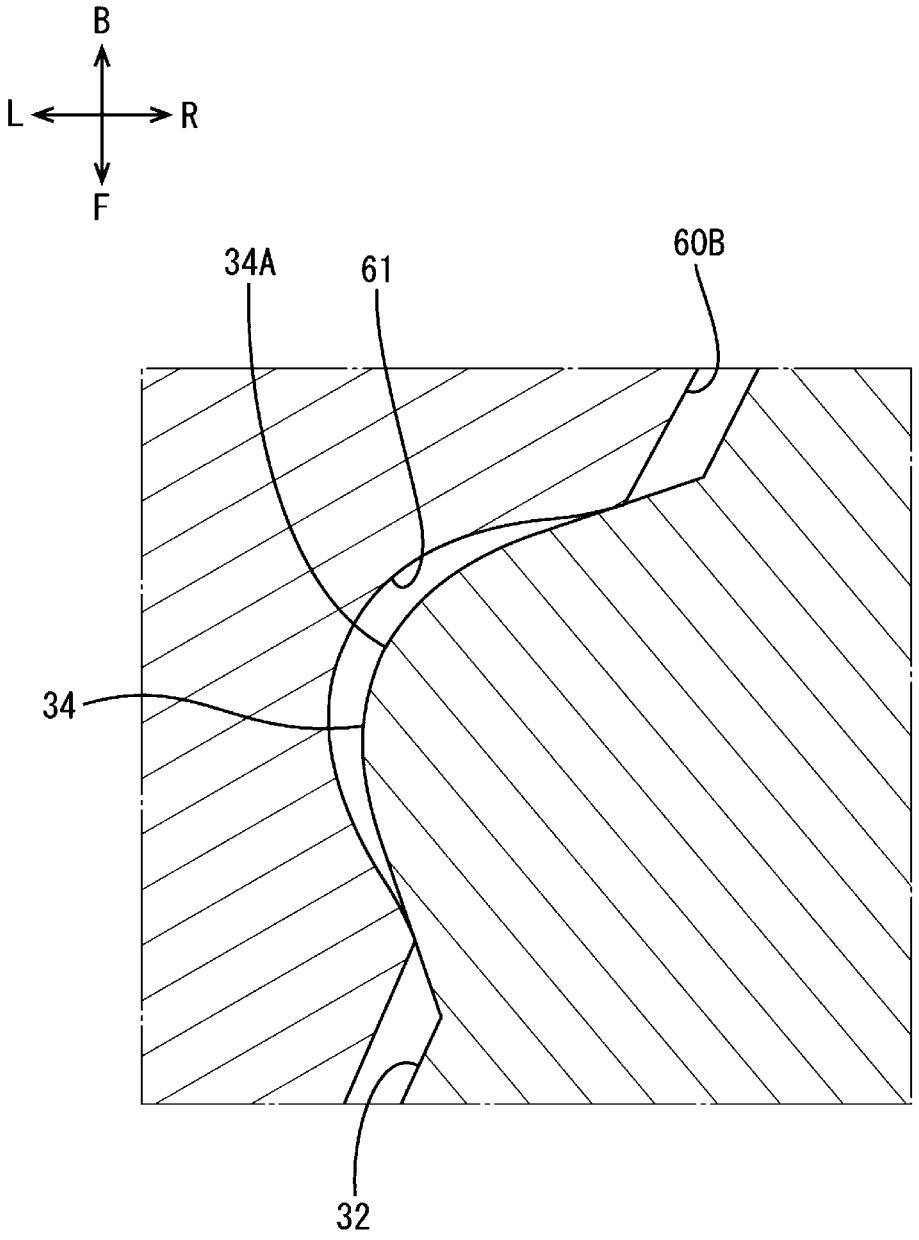
FIG. 8 is an enlarged view of a recess and a projection shown in FIG. 7.

As shown in FIGS. 6 to 8, the guide portion 30 includes the projection 34. The projection 34 is provided on the second guide surface 32 and projects from a position of the second guide surface 32 near the third guide surface 33. The projection 34 extends along the vertical direction (direction orthogonal to the planes of FIGS. 6 to 8) and is formed over the entire region of the guide portion 30 in the vertical direction. When viewed from the vertical direction, the projection 34 has a curved surface protruding radially outward.

As shown in FIG. 2, the pair of upper and lower first locking portions 35 are provided on the left surface of the cover body 28, i.e. the outer side surface of the left plate portion 28B. The first locking portion 35 is a deflectable and deformable lock arm and extends in the releasing direction from a base end serving as a deflection fulcrum. The first locking portion 15 has a first locking surface 35A facing in the connecting direction. The first locking portion 35 restricts a displacement of the lever 50 in the releasing direction by the first locking surface 35A.

As shown in FIG. 2, the pair of upper and lower second locking portions 36 are also provided on the outer side surface of the left plate portion 28B. The second locking portion 36 is formed to project from the outer side surface of the left plate portion 28B. The pair of second locking portions 36 are shifted in the vertical direction from the pair of first locking portions 35, more specifically, arranged outward of the pair of first locking portions 35 in the vertical direction. The second locking portion 36 has a second locking surface 36A facing in the releasing direction. The second locking portion 36 restricts a displacement of the lever 50 in the connecting direction by the second locking surface 36A.

The lever 50 is made of synthetic resin. The lever 50 is a member to be pinched and operated by a worker when the connector 10 is connected to the mating connector 90. Specifically, the lever 50 includes a pair of upper and lower arm portions 51, a first coupling portion 52 coupling base end sides (sides of the rotary shafts 54 to be described later) of the pair of arm portions 51 and a second coupling portion 53 coupling tip sides (sides to be pinched by the worker) of the pair of arm portions 51. Each of the arm portions 51, the first coupling portion 52 and the second coupling portion 53 is plate-like.

The lever 50 includes a pair of upper and lower rotary shafts 54 and a pair of upper and lower drive shafts 55 as shown in FIG. 6. The pair of rotary shafts 54 and the pair of drive shafts 55 are respectively arranged on a base end side of the lever 50. The pair of rotary shafts 54 and the pair of drive shafts 5 are respectively formed to project vertically inward from the inner side surfaces of the pair of arm portions 51. The pair of drive shafts 55 are arranged closer to the tip of the lever 50 than the pair of rotary shafts 54.

Figure 3:
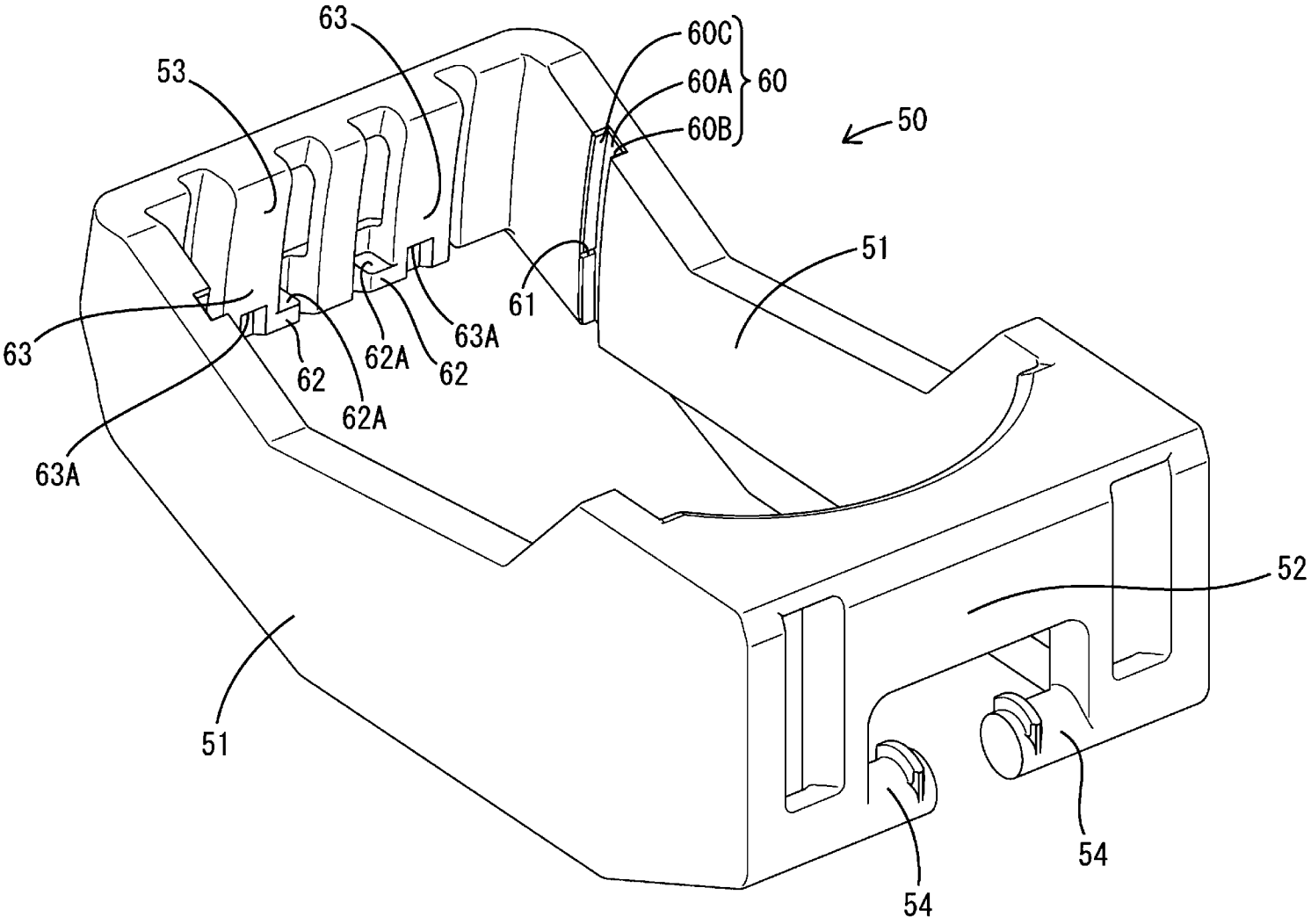
FIG. 3 is a perspective view of the lever.

As shown in FIG. 3, the lever 50 includes a pair of upper and lower guide receiving portions 60. The guide receiving portions 60 are formed on the inner side surfaces of the pair of arm portions 51, i.e. mutually facing surfaces of the pair arm portions 51. The guide receiving portion 60 is in the form of a groove arcuately extending with the rotary shaft 54 as a center and open in the front and back end surfaces of the arm portion 51. The guide receiving portion 60 has a bottom surface 60A, an inner side surface 60B and an outer side surface 60C. If a direction connecting the guide receiving portion 60 and the rotary shaft 54 is a radial direction, the inner side surface 60B is connected to a radially inner end part of the bottom surface 60A, i.e. an end part of the bottom surface 60A on the side of the rotary shaft 54. The outer side surface 60C is connected to a radially outer end part of the bottom surface 60A, i.e. an end part of the bottom surface 60A on a side opposite to the rotary shaft 54. The guide receiving portion 60 contacts the guide portion 30 of the connector body 20 and is guided by the guide portion 30. The inner and outer side surfaces 60B, 60C are arranged in parallel to each other along an arc centered on the rotary shaft 54. An interval between the inner and outer side surfaces 60B, 60C (width of the bottom surface 60A) is larger than a width of the aforementioned guide portion 30.

As shown in FIGS. 3 and 7, the lever 50 includes recesses 61. The recesses 61 are formed in the outer side surfaces 60C of the guide receiving portions 60. The recess 61 is in the form of a groove extending in the vertical direction. The projection 34 of the connector body 20 is fit into the recess 61.

As shown in FIG. 3, the lever 50 includes a pair of upper and lower first lock receiving portions 62 and a pair of upper and lower second lock receiving portions 63. The pair of upper and lower first lock receiving portions 62 and the pair of upper and lower second lock receiving portions 63 are formed on the inner side surface of the second coupling portion 53. The first lock receiving portion 62 has a first lock receiving surface 62A facing in the releasing direction. The second lock receiving portion 63 has a second lock receiving surface 63A facing in the connecting direction. The pair of second lock receiving portions 63 are shifted from the pair of first lock receiving portions 62 in the vertical direction, more specifically, arranged outwardly of the pair of first lock receiving portions 62 in the vertical direction. A displacement of the lever 50 in the releasing direction is restricted by the contact of the first lock receiving surfaces 62A with the first locking surfaces 35A of the connector body 20. A displacement of the lever 50 in the connecting direction is restricted by the contact of the second lock receiving surfaces 63A with the second locking surfaces 36A of the connector body 20.

As shown in FIGS. 2 and 6, each of the pair of sliders 80 is in the form of a rectangular plate long in the lateral direction in a plan view. The pair of sliders 80 are mounted into the connector body 20 with a plate thickness direction aligned with the vertical direction and the sliders 80 inserted in the slider guide recesses 23. The slider 80 inserted into the slider guide recess 23 is movable in the lateral direction with displacements in the front-back direction and vertical direction restricted by the slider guide recess 23.

As shown in FIGS. 2 and 6, the sliders 80 include drive shaft receiving portions 81. The drive shaft receiving portions 81 are formed in the outer side surfaces of the pair of sliders 80 (surfaces facing outward in the vertical direction with the sliders 80 inserted in the slider guide recesses 23). The drive shaft receiving portion 81 is arranged on a right end side of the slider 80. The drive shaft receiving portion 81 is open in the back surface of the slider 80. The drive shaft 55 of the lever 50 is accommodated into the drive shaft receiving portion 81. The sliders 80 move in the lateral direction by the drive shaft receiving portions 81 being pushed by the drive shafts 55 according to the rotation of the lever 50. Specifically, the sliders 80 move leftward according to the rotation of the lever 50 in the connecting direction and move rightward according the rotation of the lever 50 in the releasing direction.

As shown in FIG. 6, the slider 80 includes a plurality of (three in this embodiment) cam grooves 85 arranged in the lateral direction. The cam grooves 85 are formed in the inner side surface (surface opposite to the outer side surface) of each of the pair of sliders 80. The entrances of the cam grooves 85 are open in the front surface of the slider 80. The cam groove 85 extends obliquely rightward toward a back side from the entrance in the front surface of the slider 80.

The mating connector 90 includes cam followers 91 at positions corresponding to the respective cam grooves 85.

An assembling procedure of the connector 10 is described next.

First, the pair of sliders 80 are mounted into the housing 21. Then, the lever 50 is mounted on the housing 21 from behind. Thereafter, the unillustrated terminal fittings are inserted into the housing 21 and the wire cover 22 is assembled with the housing 21. In the above way, the assembling of the connector 10 is completed.

Functions and effects of the connector 10 are described.

In connecting the connector 10 to the mating connector 90, the lever 50 is arranged at the initial position as shown in FIG. 4. At the initial position, the tip sides of the arm portions 51 are arranged behind the wire cover 22. The rotary shafts 54 of the lever 50 are fit into the rotary shaft receiving portions 24 of the housing 21 and the drive shafts 55 of the lever 50 are fit into the drive shaft receiving portions 81 of the sliders 80. Further, the drive shafts 55 are arranged behind and to the right of the rotary shafts 54. The mating connector 90 is lightly connected from front of the connector 10, and the cam followers 91 of the mating connector 90 are arranged at the entrances of the cam grooves 85. If the lever 50 is rotated in the connecting direction with the rotary shafts 54 as a center from this state, the cam followers 91 slide on groove surfaces of the cam grooves 85 and the sliders 80 move leftward. According to these movements of the sliders 80, the connection of the connector 10 and the mating connector 90 proceeds.

The lever 50 rotating in the connecting direction passes through the guide start position and reaches the guide end position. The guide start position is a position where tip parts in the rotating direction (end parts in the connecting direction) of the outer side surfaces 60C and the first guide surfaces 31 are radially spaced apart and facing each other. At the guide start position, the outer side surfaces 60C of the guide receiving portions 60 of the lever 50 are facing the first guide surfaces 31 of the guide portions 30 while being radially spaced apart from the first guide surfaces 31 as shown in FIG. 5.

In the process of rotating the lever 50 to the guide end position, the outer side surfaces 60C of the guide receiving portions 60 are in contact with the guide surfaces 30A of the guide portions 30 while the tips in the rotating direction (end parts in the connecting direction) of the guide receiving portions 60 move from the third guide surfaces 33 to the second guide surfaces 32. A contact pressure received from the guide surfaces 30A by the outer side surfaces 60C of the guide receiving portions 60 gradually increases as the lever 50 is rotated by the inclination of the third guide surfaces 33. The lever 50 can smoothly move from the guide start position to the guide end position.

When the outer side surfaces 60C of the guide receiving portions 60 contact the guide surfaces 30A of the guide portions 30, a force is applied to the lever 50 in a direction away from the rotary shafts 54 (radially outward). The rotary shafts 54 contact the rotary shaft receiving portions 24 while pressing the rotary shaft receiving portions 24 in the direction of this force.

When the lever 50 reaches the guide end position, the contact pressure received from the second guide surfaces 32 of the guide portions 30 by the outer side surfaces 60C of the guide receiving portions 60 as shown in FIGS. 6 and 7 has a maximum value. Note that although the inner side surfaces 60B of the guide receiving portions 60 do not contact parts in the releasing direction on the radially inner surfaces of the guide portions 30 from the guide start position to the guide end position in this embodiment, the inner side surfaces 60B may contact these parts.

The second guide surface 32 is arranged at a position more away from the rotary shaft 54 than the first guide surface 31. Thus, the guide receiving portions 60 of the lever 50 contact the guide portions 30 with a larger contact pressure when the lever 50 is at the guide end position than when the lever 50 is at the guide start position. Therefore, this connector 10 can suppress the rattling of the lever 50 arranged at the guide end position and the connector body 20.

When the lever 50 reaches the guide end position, the recesses 61 of the lever 50 are resiliently fit to the projections 34 on the second guide surfaces 32. When the projections 34 are fit into the recesses 61, the worker is given a click feeling and can stop the rotating operation of the lever 50. A position where the recesses 61 of the lever 50 are fit to the projections 34 on the second guide surfaces 32 is the guide end position. Further, in the state fit to the projection 34, the recess 61 is in contact with the projection 34 on both sides in the rotating direction when viewed from the vertical direction as shown in FIG. 8. That is, when viewed from the vertical direction, the recess 61 is not in contact with a top 34A of the projection 34 and both side surface thereof are respectively in contact with the projection 34 on both sides in the rotating direction. Thus, a state where the projection 34 is fit in the recess 61 without rattling is maintained. As a result, the position (posture) of the lever 50 with respect to the connector body 20 can be kept constant at the guide end position in the connector 10. Note that the recess 61 may be in surface contact, rather than in point contact, with the projection 34.

Figure 9:
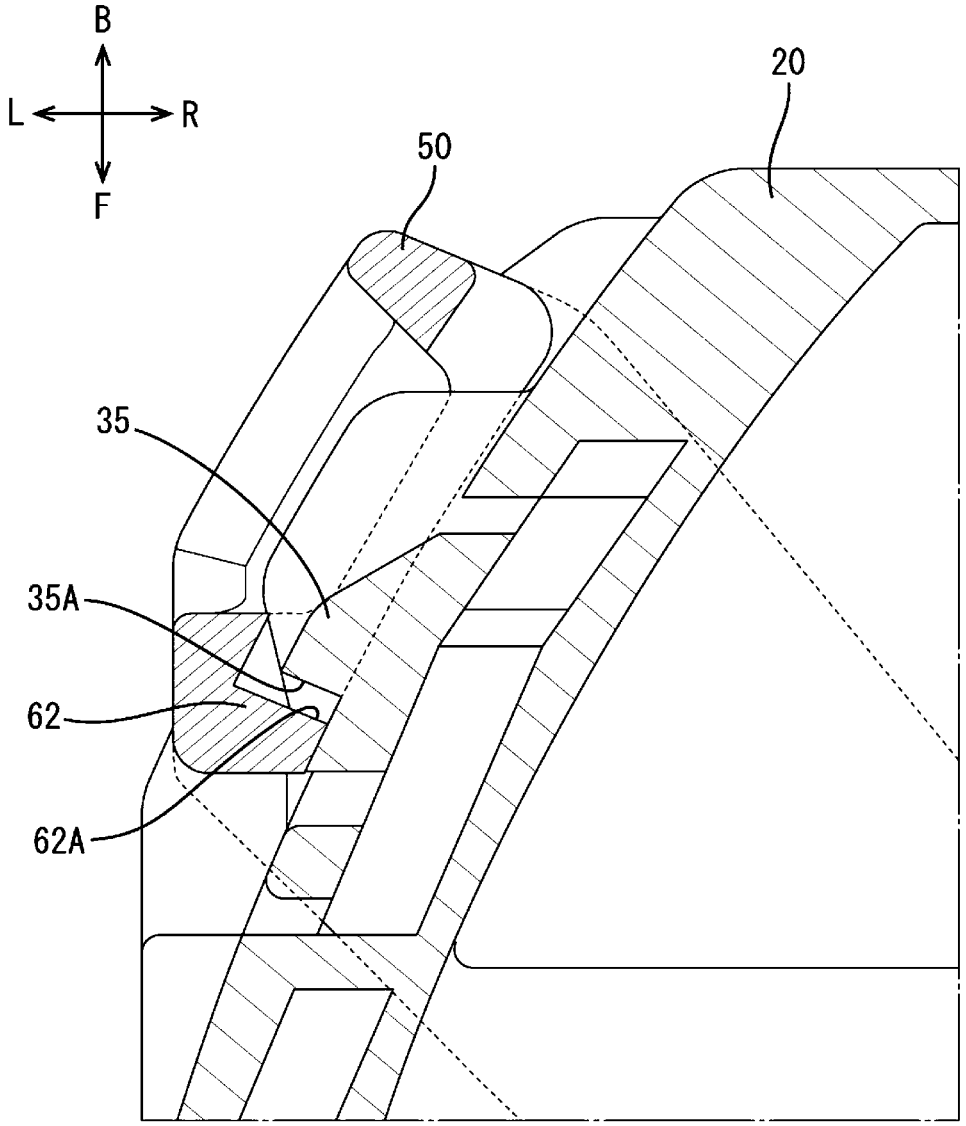
FIG. 9 is a plan view in section showing a positional relationship of a first locking portion and a first lock receiving portion when the lever is arranged at the guide end position.

In the process of rotating the lever 50 from the guide start position to the guide end position, the first locking portions 35 of the lever 50 deflect the first lock receiving portions 62 of the connector body 20 and are, thereafter, arranged behind the resiliently returned first lock receiving portions 62 in the connecting direction. When the lever 50 is at the guide end position, the first locking portions 35 (more specifically, the first locking surfaces 35A) and the first lock receiving portions 62 (more specifically, first lock receiving surfaces 62A) do not contact each other and are arranged to face each other in the rotating direction of the lever 50 as shown in FIGS. 9 and 11.

Figure 10:
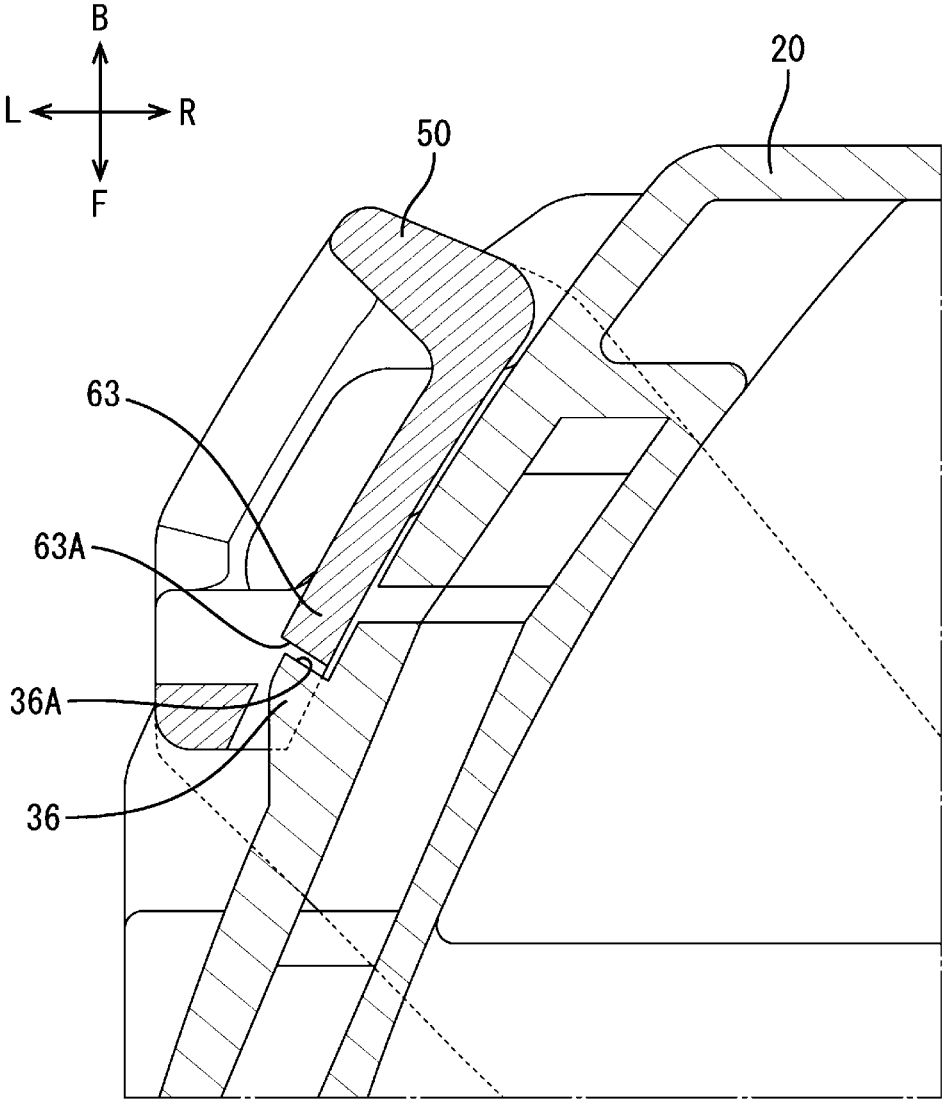
FIG. 10 is a plan view in section showing a positional relationship of a second locking portion and a second lock receiving portion when the lever is arranged at the guide end position.
Figure 11:
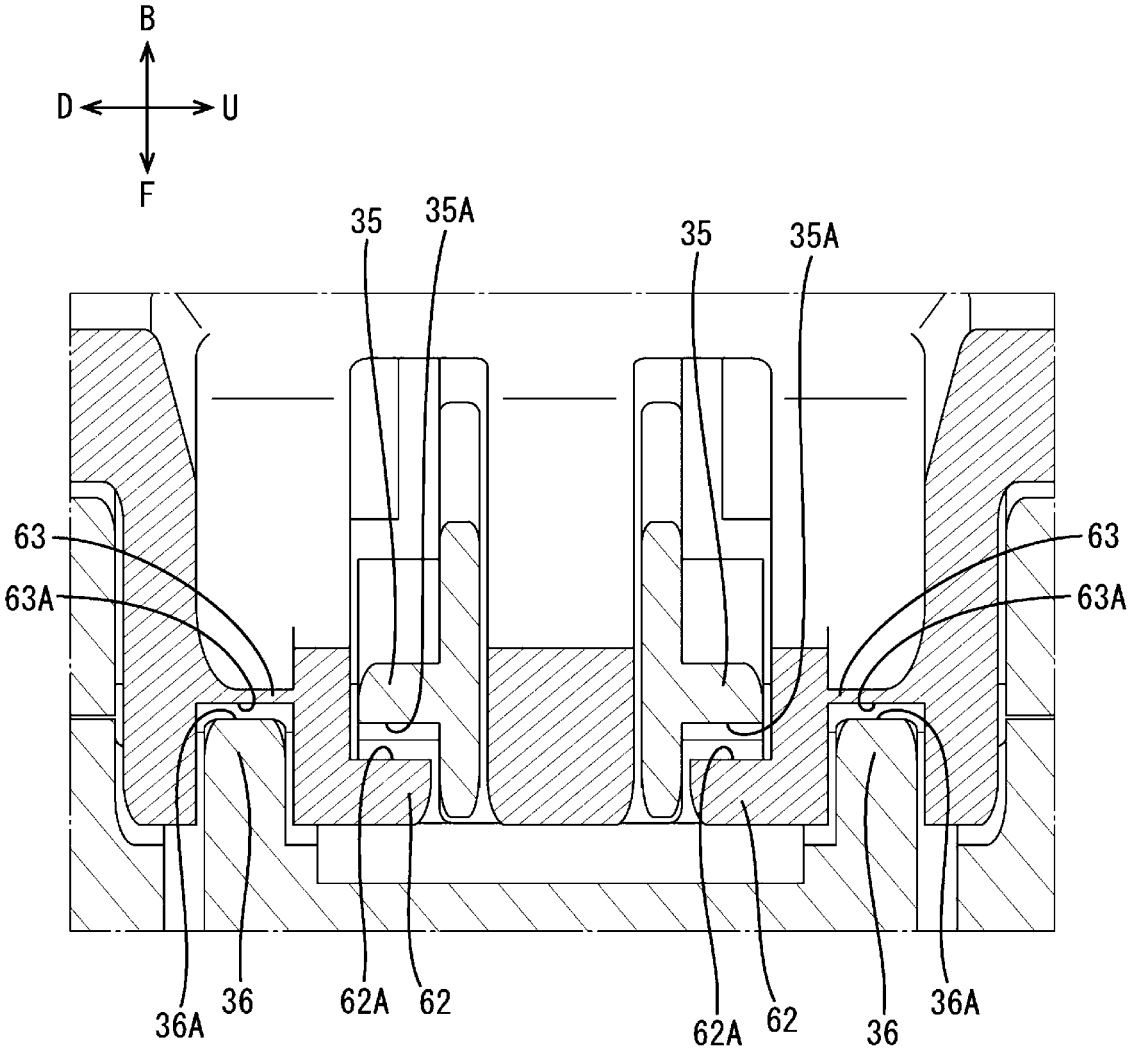
FIG. 11 is a left side view in section of the connector cut along a plane passing through the first locking portions, the second locking portions, the first lock receiving portions and the second lock receiving portions in the state where the lever is arranged at the guide end position.

Further, when the lever 50 is at the guide end position, the second locking portions 36 of the lever 50 are arranged behind the second lock receiving portions 63 of the connector body 20 in the releasing direction and the second locking portions 36 (more specifically, the second locking surfaces 36A) and the second lock receiving portions 63 (more specifically, second lock receiving surfaces 63A) do not contact each other and are arranged to face each other in the rotating direction of the lever 50 as shown in FIGS. 10 and 11.

Accordingly, if external vibration is applied to the connector 10, the transmission of the vibration between the first locking portions 35 and the first lock receiving portions 62 can be suppressed and the transmission of the vibration between the second locking portions 36 and the second lock receiving portions 63 can be suppressed. Further, even if the lever 50 moves in the rotating direction from the guide end position when the external vibration is applied to the connector 10, a displacement in the releasing direction can be restricted by the first locking portions 35 and a displacement in the connecting direction can be restricted by the second locking portions 36.

Other Embodiments of Present Disclosure

The embodiment disclosed this time should be considered illustrative in all aspects, rather than restrictive.

(1) Although the guide surface (specifically, the first, second and third guide surfaces) of the guide portion is bent at intermediate positions to bring the guide surface more away from the rotary shaft as a configuration for "causing the guide receiving portion to contact the guide portion with a larger contact pressure when the lever is at the guide end position than when the lever is at the guide start position" in the above embodiment, another configuration may be adopted. For example, the entire guide surface of the guide portion may be configured to gradually separate from the rotary shaft along the connecting direction. Alternatively, the guide receiving portion may have a guide surface. Alternatively, a shortest distance between the outer peripheral surface of the rotary shaft and the guide surface may be made shorter when the lever is at the guide end position than when the lever is at the guide start position by causing the rotary shaft to project in the radial direction.

(2) Although both the guide portion and the guide receiving portion arcuately extend in the above embodiment, at least one of these may arcuately extend. For example, the guide receiving portion may be a protrusion for contacting the arcuately extending guide portion.

(3) The projection only has to be configured to fit into the recess and is not limited to the configuration in which the projection is in contact with the recess at two positions in the rotating direction when viewed from a direction parallel to the axis of the rotary shaft.

(4) Although the outer side surface of the guide receiving portion is arranged away from the first guide surface at the guide start position in the above embodiment, the outer side surface of the guide receiving portion may contact the first guide surface of the guide portion with a smaller contact pressure at the guide start position than at the guide end position.

(5) Although the sliders including the cam grooves are provided separately from the lever in the above embodiment, the lever may include cam grooves. If the lever includes the cam grooves, the sliders can be omitted.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a connector body including a guide portion; and a lever including a guide receiving portion for contacting the guide portion, the lever being operated to connect the connector to a mating connector, wherein:

the lever is rotatable about a rotary shaft with respect to the connector body to a guide start position where guide by the guide portion is started and a guide end position where the guide by the guide portion is ended, at least one of the guide portion and the guide receiving portion arcuately extends with the rotary shaft as a center, the guide receiving portion contacts the guide portion with a larger contact pressure when the lever is at the guide end position than when the lever is at the guide start position, one of the guide portion and the guide receiving portion has a first guide surface in contact with or facing the other at the guide start position, a second guide surface arranged at a position more away from the rotary shaft than the first guide surface and in contact with the other at the guide end position, and a third guide surface obliquely connected to the first and second guide surfaces, the one of the guide portion and the guide receiving portion includes a projection on the second guide surface, the other includes a recess to be fit to the projection at the guide end position, and the recess is in contact with the projection on both sides in a rotating direction of the lever when viewed from a direction parallel to an axis of the rotary shaft.

2. A connector, comprising:

a connector body including a guide portion; and a lever including a guide receiving portion for contacting the guide portion, the lever being operated to connect the connector to a mating connector, wherein:

the lever is rotatable about a rotary shaft with respect to the connector body to a guide start position where guide by the guide portion is started and a guide end position where the guide by the guide portion is ended, at least one of the guide portion and the guide receiving portion arcuately extends with the rotary shaft as a center, the guide receiving portion contacts the guide portion with a larger contact pressure when the lever is at the guide end position than when the lever is at the guide start position, the connector body includes a locking portion, the lever includes a lock receiving portion lockable to the locking portion, and the locking portion and the lock receiving portion do not contact each other and are arranged to face each other in a rotating direction of the lever when the lever is at the guide end position.

* * * * *